US011384552B2

(12) United States Patent
Huang et al.

(10) Patent No.: US 11,384,552 B2
(45) Date of Patent: Jul. 12, 2022

(54) MASSAGE SYSTEM FOR INFLATABLE POOL

(71) Applicant: BESTWAY INFLATABLES & MATERIAL CORP., Shanghai (CN)

(72) Inventors: Shuiyong Huang, Shanghai (CN); Roger Zhang, Shanghai (CN); Xingdi Wu, Shanghai (CN); Jing Wan, Shanghai (CN)

(73) Assignee: BESTWAY INFLATABLES & MATERIAL CORP., Shanghai (CN)

( * ) Notice: Subject to any disclaimer, the term of this patent is extended or adjusted under 35 U.S.C. 154(b) by 0 days.

(21) Appl. No.: 16/965,000

(22) PCT Filed: Jan. 31, 2018

(86) PCT No.: PCT/CN2018/074778
§ 371 (c)(1),
(2) Date: Jul. 26, 2020

(87) PCT Pub. No.: WO2019/148381
PCT Pub. Date: Aug. 8, 2019

(65) Prior Publication Data

US 2021/0108431 A1 Apr. 15, 2021

(51) Int. Cl.
*E04H 4/00* (2006.01)
*A61H 33/02* (2006.01)

(52) U.S. Cl.
CPC ..... *E04H 4/0025* (2013.01); *A61H 33/02* (2013.01); *A61H 2201/0103* (2013.01)

(58) Field of Classification Search
CPC ..... E04H 4/0025
USPC ..... 4/496, 488, 505
See application file for complete search history.

(56) References Cited

U.S. PATENT DOCUMENTS

| | | | |
|---|---|---|---|
| 5,548,851 | A | 8/1996 | Wien et al. |
| 5,548,852 | A | 8/1996 | Rowe |
| 6,108,829 | A | 8/2000 | Wadsworth |
| 2005/0235406 | A1 | 10/2005 | August |
| 2009/0106889 | A1 | 4/2009 | Brown |
| 2011/0010836 | A1 | 1/2011 | Lau |
| 2012/0297530 | A1 | 11/2012 | Huang |

FOREIGN PATENT DOCUMENTS

| | | |
|---|---|---|
| CN | 2461536 | 11/2001 |
| CN | 2832129 | 11/2006 |
| CN | 201099997 | 8/2008 |
| CN | 201106294 | 8/2008 |

(Continued)

OTHER PUBLICATIONS

First Chinese Office Action dated May 21, 2021 (dated May 21, 2021) issued on related Chinese patent application 201880087510.3 by The State Intellectual Property Office of People's Republic of China.

(Continued)

*Primary Examiner* — Lori L Baker
(74) *Attorney, Agent, or Firm* — Dickinson Wright PLLC

(57) ABSTRACT

An air passageway system (100) includes an annular air delivery passageway (132), a linear air delivery passageway (112*b*), and one or more air injection passageways (134*a*-1341, 116). The annular air delivery passageway (132), the linear air delivery passageway (112*b*), and the one or more air injection passageways (134*a*-1341, 116) are constructed from flexible polyvinyl chloride walls.

15 Claims, 8 Drawing Sheets

(56) References Cited

FOREIGN PATENT DOCUMENTS

| | | |
|---|---|---|
| CN | 101389820 | 3/2009 |
| CN | 203129640 | 8/2013 |
| CN | 203654810 | 6/2014 |
| CN | 103912147 | 7/2014 |
| CN | 203684742 | 7/2014 |
| CN | 204139662 | 2/2015 |
| CN | 204343723 | 5/2015 |
| CN | 204814786 | 12/2015 |
| CN | 206233650 | 6/2017 |
| EP | 1336400 | 8/2003 |

OTHER PUBLICATIONS

Extended European Search Report dated Aug. 26, 2021 (dated Aug. 26, 2021) issued on related European patent application 18903365.7 by the European Patent Office.

Written Opinion of the International Searching Authority dated Oct. 22, 2018 issued on related international application PCT/CN2018/074778 by the State Intellectual Property of the P.R. China.

Chinese Office Action dated Jan. 13, 2022 (Jan. 13, 2022) on related Chinese patent application 201880087510.3.

MASSAGE SYSTEM FOR INFLATABLE POOL

CROSS-REFERENCE TO RELATED APPLICATION

This application is a 35 U.S.C. § 371 national stage application of and which claims the benefit and priority of PCT Application Ser. No. PCT/CN2018/074778, filed on Jan. 31, 2018, which is hereby incorporated by reference in its entirety.

TECHNICAL FIELD

The present subject matter relates to inflatables and, more particularly to injecting air into water contained within spas/pools and the air passageways therefor.

BACKGROUND

Often times, it is useful, beneficial, and/or entertaining to aerate water or create recreational/therapeutic water movement within a pool and/or spa, such as by way of jets and/or bubbles. However, not all spas and/or pools have piping and other water aeration accessories integrated therein to facilitate such amusements. A particular challenge exists concerning the circulation of air within an inflatable pool/spa, especially when such a pool/spa may be foldable, transportable, storable, etc. Therefore, introduction of a system for dispersing air within and throughout an inflatable pool and/or spa represents an improvement in the art.

In the current state of the art, pipes made from lightweight metal or rigid plastic materials may be added to existing pump and/or filter mechanisms compatible with inflatable pools. The addition of rigid piping into the walls and/or floor of an inflatable pool is technically difficult, inconvenient, and adds time to set-up and tear-down. However, such attachments that may aim to achieve incorporation of jets (air and/or water) may not be universally portable to inflatable pools and/or spas, especially inflatable pools and/or spas omitting a rigid frame.

To solve this challenge, the below disclosure sets forth an air passageway system for incorporation into an inflatable spa/pool. Still further, the apparatus and system contemplated herein may be flexible and may provide for the introduction of aeration/air bubbles proximal a center of the inflatable spa/pool.

The description provided in the background section should not be assumed to be prior art merely because it is mentioned in or associated with the background section. The background section may include information that describes one or more aspects of the subject technology.

SUMMARY

According to an aspect of the present disclosure, an air passageway system includes an annular air delivery passageway, a linear air delivery passageway, and one or more air injection passageways. In accordance with this aspect, the annular air delivery passageway, the linear air delivery passageway, and the one or more air injection passageways are constructed from flexible polyvinyl chloride walls.

According to another aspect of the present disclosure, a system for aerating an inflatable spa includes one or more air delivery passageways, one or more air injection passageways, and one or more apertures for dispersing air from the one or more air injection passageways into water contained within the inflatable spa. Further in accordance with this aspect, the one or more air delivery passageways are disposed within a sidewall and a floor of the inflatable spa, and at least one of the one or more air delivery passageways partially surround the floor of the inflatable spa. Further still, a portion of the floor is comprised of at least one of the one or more air injection passageways and the one or more air delivery passageways.

According to yet another aspect of the present disclosure, an air passageway system includes one or more air passageways, a plurality of internal passageway walls, and at least one space partially defined by first and second internal passageway walls of the plurality of internal passageway walls. Further according to this system, the one or more air passageways are comprised of the at least one space partially defined by the first and second internal passageway walls.

Other aspects and advantages of the present invention will become apparent upon consideration of the following detailed description and the attached drawings wherein like numerals designate like structures throughout the specification.

BRIEF DESCRIPTION OF THE DRAWINGS

The accompanying drawings, which are included to provide further understanding and are incorporated in and constitute a part of this specification, illustrate disclosed embodiments and together with the description serve to explain the principles of the disclosed embodiments. In the drawings.

In one or more implementations, not all of the depicted components in each figure may be required, and one or more implementations may include additional components not shown in a figure. Variations in the arrangement and type of the components may be made without departing from the scope of the subject disclosure. Additional components, different components, or fewer components may be utilized within the scope of the subject disclosure. In the accompanying drawings, capitalized letters "A-L" are used interchangeably with lower-case letters "a-l" for purposes of clarity.

DETAILED DESCRIPTION

The detailed description set forth below is intended as a description of various implementations and is not intended to represent the only implementations in which the subject technology may be practiced. As those skilled in the art would realize, the described implementations may be modified in various different ways, all without departing from the scope of the present disclosure. Still further, modules and components depicted may be combined, in whole or in part, and/or divided, into one or more different parts, as applicable to fit particular implementations without departing from the scope of the present disclosure. Accordingly, the drawings and description are to be regarded as illustrative in nature and not restrictive.

Figure 1A:
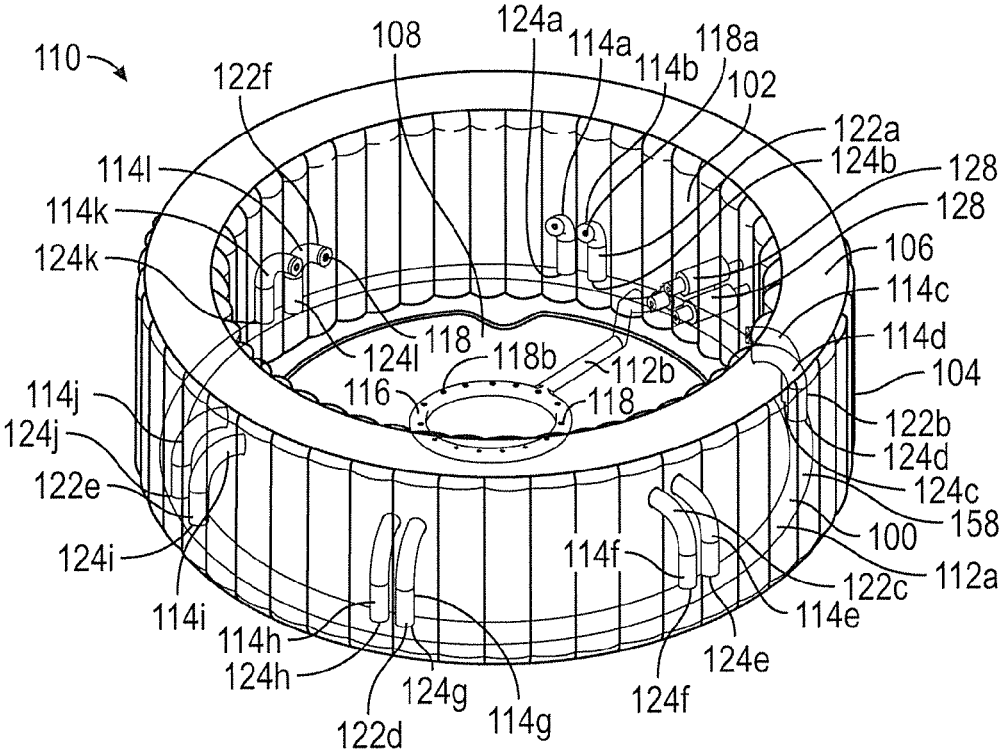
FIG. 1A is an example embodiment of an air passageway system in accordance with the present disclosure and shown with transparent sidewalls as well as bottom/floor and sidewall air passageways disposed within an inflatable spa.

With reference to FIG. 1A, an inflatable spa 110 constructed in accordance with the present disclosure is illustrated with interior and exterior surfaces 102, 104 thereof shown as transparent. An air passageway system 100 is disposed within a sidewall 106 and/or a bottom/floor 108 of the inflatable spa 110 and includes a plurality of air passageways 158. The air passageway system 100 comprises an annular air delivery passageway 112*a*, a bottom/floor air delivery passageway 112*b*, and upward air injection passageways 114A-114L. The bottom/floor air delivery passageway 112*b* may be linear across an extent of the bottom/floor 108. The air passageway system 100 further comprises an air injection ring passageway 116. The bottom/floor air delivery passageway 112*b* (and thereby the air injection passageway 116) and the annular air delivery passageway 112*a* may share and air inlet and be in fluid communication with one another. Each of the upward air injection passageways 114A-114L may inject air into/aerate water contained within the inflatable spa 110 through one or more air injection apertures 118*a* that traverse the interior side surface 102. Additionally, the air injection ring passageway 116 may inject air into/aerate the water contained within the inflatable spa 110 through air injection apertures 118*b*.

Figure 10:
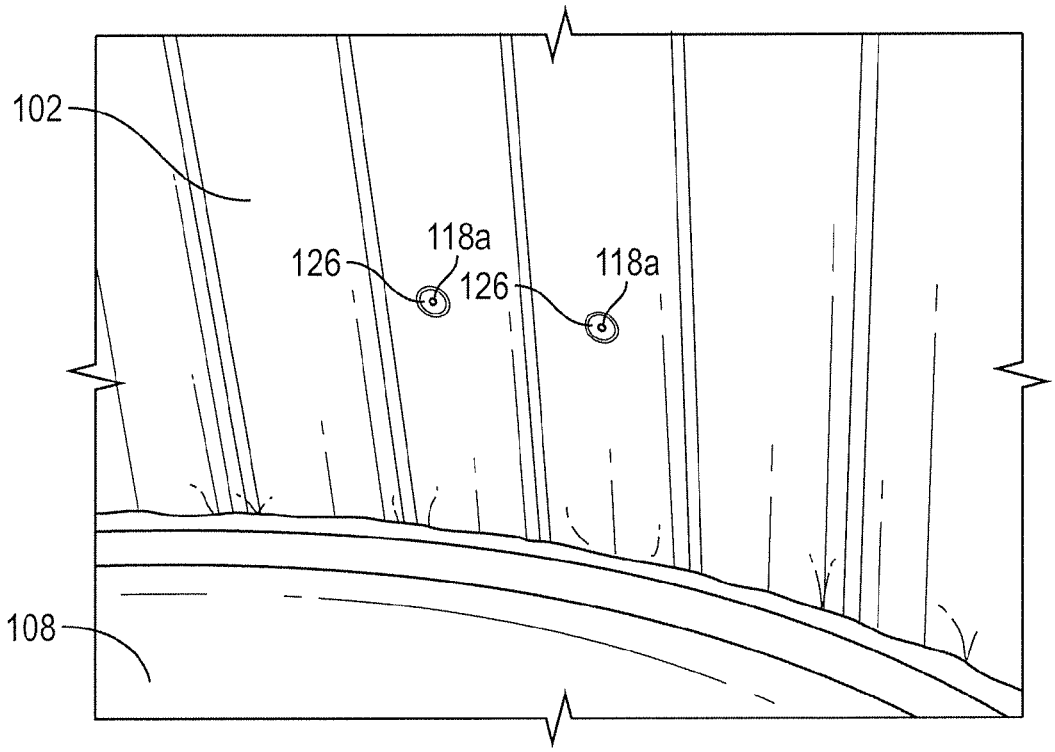
FIG. 10 is an enlarged view of a portion of an interior surface of the spa of FIG. 1, further illustrating nozzles and apertures.

The annular air delivery passageway 112*a* of the air passageway system 100 is disposed proximal a bottom of the sidewall 106, as shown in FIG. 1A, and travels about a perimeter of the inflatable spa 110 to deliver air to the upward-oriented air injection passageways 114A-114L. The upward air injection passageways 114A-114L are disposed in pairs 122*a*-122*f*. and extend vertically away from coupling points 124A-124L with the annular air deliver passageway 112*a*. The upward air injection passageways 114A-114L form a hook or j-shape as same curve towards the interior surface 102 of the sidewall 106 to feed air through the air injection apertures 118*a* positioned therethrough. Example embodiments may include one or more nozzles 126 associated with each of the air injection apertures 118*a* (FIG. 10).

Figure 1B:
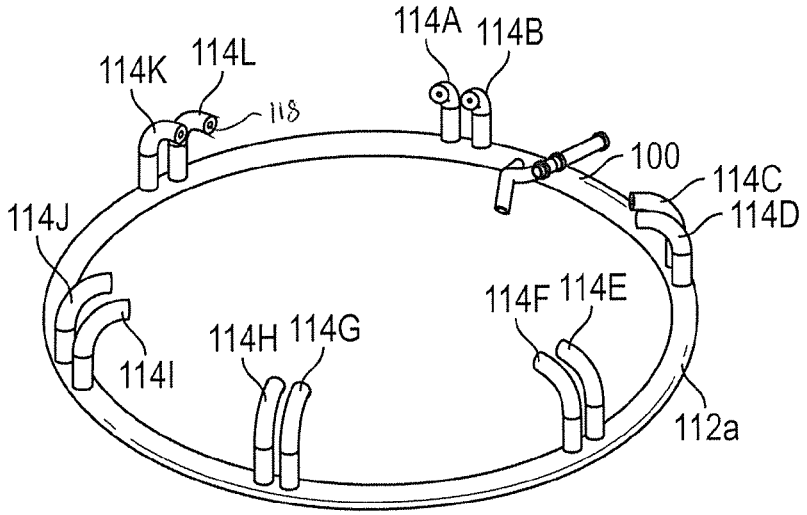
FIG. 1B is an example embodiment of the air passageway system of FIG. 1A with the sidewalls, bottom, and floor of the inflatable spa omitted.
Figure 1C:
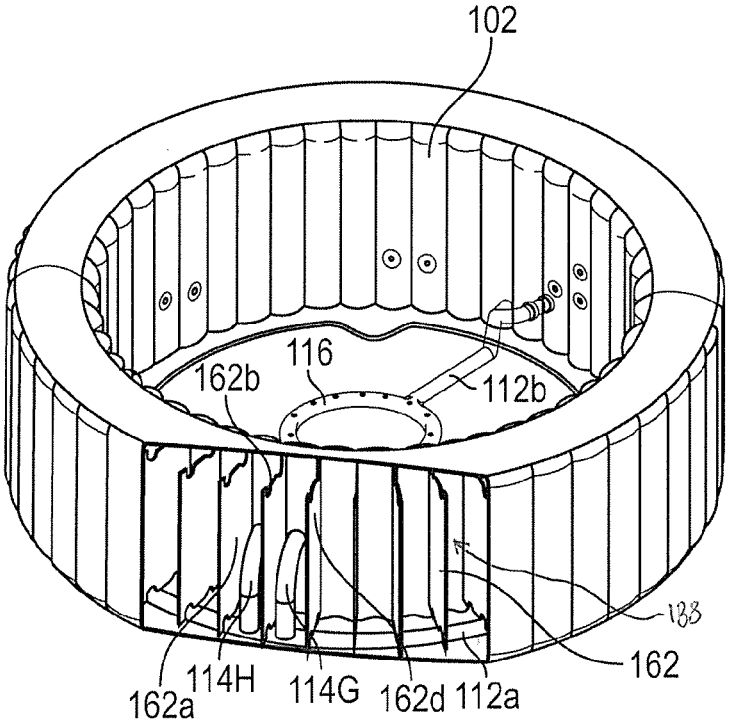
FIG. 1C is an example embodiment of the air passageway system of FIG. 1A shown through a cutaway of the sidewalls of the inflatable spa.

Further in the example embodiment of FIG. 1A, the bottom/linear air delivery passageway 112*b* extends from the sidewall 106 of the inflatable spa 110 towards the center/middle of the bottom 108 of the inflatable spa 110 to deliver air to the air injection ring passageway 116. Air may be provided to the bottom air delivery passageway 112*b* and the annular air delivery passageway 112*a* by an air intake connection 128. The air intake connection 128 may couple the air delivery passageways 112*a*, 112*b* with a pump mechanism. The pump mechanism may be disposed between the interior and exterior walls 102, 104 of the inflatable spa 110 or the pump mechanism may be disposed outside of the inflatable spa 110 as a separate component and/or within a separate housing. The pump mechanism may be a component of a filter system and may draw air from the ambient environment or may draw air from within the inflatable spa 110 while replacing said air within the inflatable 110 by another air intake, such as the air intake used during inflation of the inflatable spa 110. In an example embodiment, the air delivery passageways 112*a*, 112*b* may have a dedicated air intake with access to outside air. Further in example embodiments, the air delivery passageways 112*a*, 112*b* may be supplied with air from an air source, such as an air tank, compressor, and/or another suitable source of pressurized gas. FIG. 1B further illustrates the relative locations of the annular air delivery passageway 112*a* and the upward air injection passageways 114A-114L. FIG. 1C depicts a cutaway through the sidewall 106 and illustrates the relative location of the upward air injection passageways 114G, 114H, respectively, disposed between interior panels 162*c*, 162*b* and 162*b*, 162*a*. The annular air delivery passageway 112*a* travels about a perimeter of the inflatable spa 110 beneath and/or through the interior panels 162.

Figure 2A:
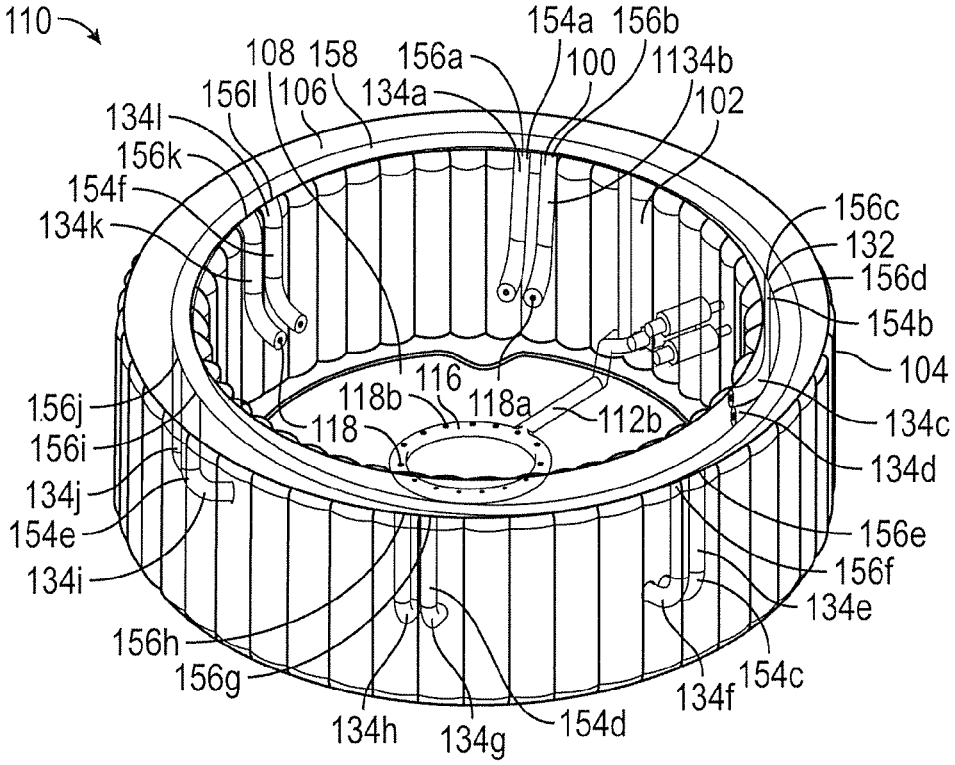
FIG. 2A is another example embodiment of an air passageway system in accordance with the present disclosure and shown with transparent sidewalls as well as bottom and sidewall air passageways disposed therein.

Referring now to FIG. 2A, example embodiment of the air passageway system 100 is constructed in accordance with the present disclosure. Again, the interior and exterior side surfaces 102, 104 are shown as transparent in FIG. 2A. An embodiment of the air passageway system 100 is disposed within the sidewall 106 and/or the bottom 108 of the inflatable spa 110. The example embodiment depicted in FIG. 2A includes the bottom/linear air delivery passageway 112*b* and the air injection ring passageway 116 similar to that shown in FIG. 1. The example embodiment of FIG. 2A further comprises an elevated annular air delivery passageway 132 disposed within the sidewall 106 of the inflatable spa 110 and elevated vertically therein.

Figure 2B:
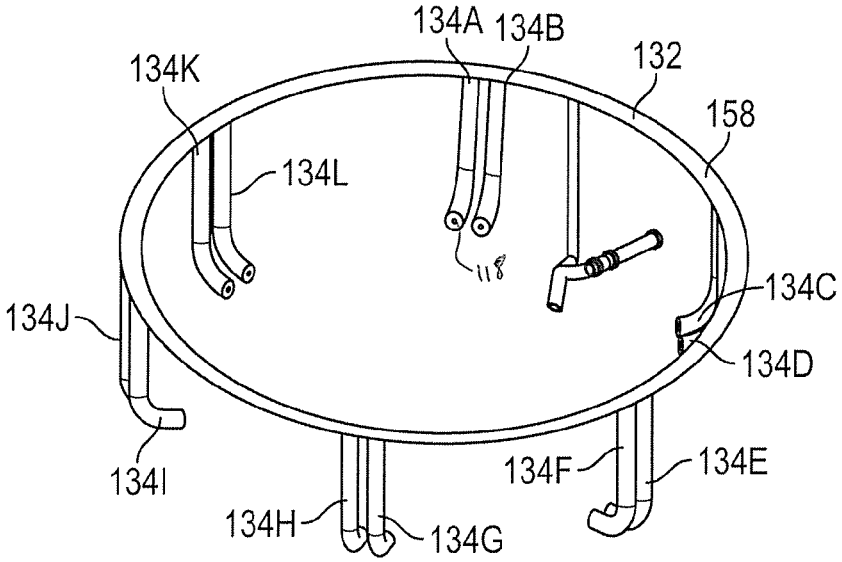
FIG. 2B is an example embodiment of the air passageway system of FIG. 2A with the sidewalls, bottom, and floor of the inflatable spa omitted.
Figure 2C:
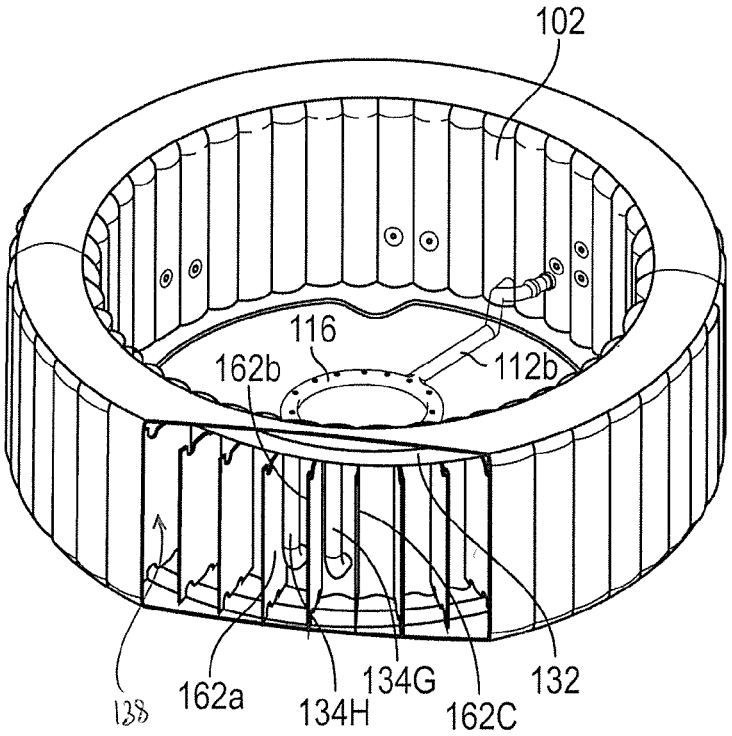
FIG. 2C is an example embodiment of the air passageway system of FIG. 2A shown through a cutaway of the sidewalls of the inflatable spa.

In the configuration of FIG. 2A, the elevated annular air delivery passageway 132 is arranged within an upper portion of the sidewall 106 and travels about a perimeter of the inflatable spa 110 to deliver air to downward-oriented air injection passageways 134A-134L. The downward-oriented air injection passageways 134A-134L form a hook or j-shape and extend vertically down from the elevated annular air delivery passageway 132 before curving towards the interior surface 102 of the sidewall 106. The downward-oriented air injection passageways 134A-134L meet the interior surface 102 and disperse air through the air injection apertures 118*a* that traverse the interior surface 102 and direct air into the water contained within the inflatable spa 110. The downward-oriented air injection passageways 134A-134L are coupled to the elevated annular air delivery passageway 132 at coupling points 156A-156L and are arranged in pairs 154*a*-154*f* about the annular perimeter of the inflatable spa 110. FIG. 2A again depicts the bottom air delivery passageway 112*b*, the air injection ring passageway 116, and the air injection apertures 118*b*. disposed through the interior surface 102 of the bottom 108 of the inflatable spa 110 about a general center/interior thereof. In further example embodiments, the air injection ring passageway 116 may be configured offset or otherwise not disposed generally about a center of the inflatable spa bottom 108. In an example embodiment, the annular air delivery passageways 112*a*, 132 and the air injection passageways 114A-114L, 134A-134L may transport and output jets/streams of pressurized water, instead of air. Accordingly, kneading water jets and or wave-like water movement may be introduced into the water of the inflatable spa 110. FIG. 2B further illustrates the relative locations of the elevated annular air delivery passageway 132 and the downward-oriented air injection passageways 134A-134L. FIG. 2C depicts a cutaway through the sidewall 106 and illustrates the relative location of the downward-oriented air injection passageways 134G, 134H, respectively, disposed between interior panels 162*c*, 162*b* and 162*b*, 162*a*. The elevated annular air delivery passageway 132 travels about a perimeter of the inflatable spa 110 above and/or through the interior panels 162.

Figure 3:
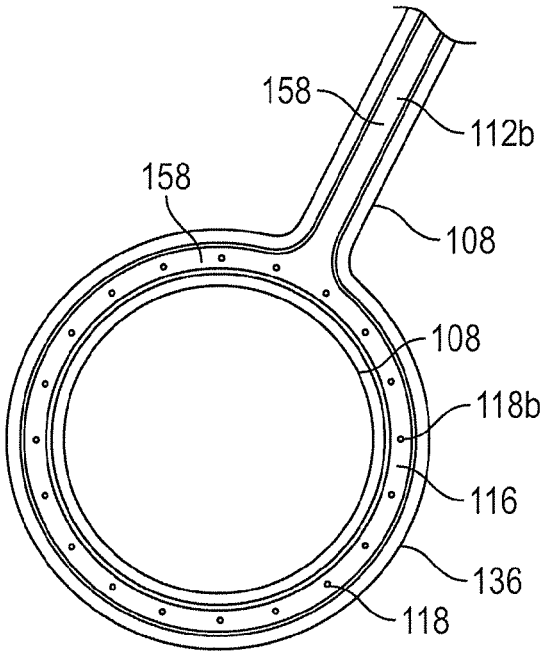
FIG. 3 is an enlarged plan view of a bottom/floor air passageway.

Referring now to FIG. 3, the air injection ring passageway 116 is shown enlarged and in detail. As mentioned hereinabove, the bottom air delivery passageway 112*b* supplies air to the air injection ring passageway 116. In the example embodiment shown in FIG. 3, both the air injection ring passageway 116 and the bottom air delivery passageway 112*b* are at least partially surrounded by an insulating material 136, such as expandable polyethylene (EPE) and/or another suitable material. The insulating material 136 may be disposed throughout the bottom 108 and sidewall 106 of the inflatable spa 110 to increase insulation and softness thereof. The insulating material 136 may also take up space within one or more interior compartments 138, between interior panels 162 (FIGS. 1C and 2C) of the inflatable spa 110 or between bottom/floor walls 102*b*, 104*b*, such that a relatively lesser volume of air is required to fully inflate the inflatable spa/pool 110.

Figure 4:
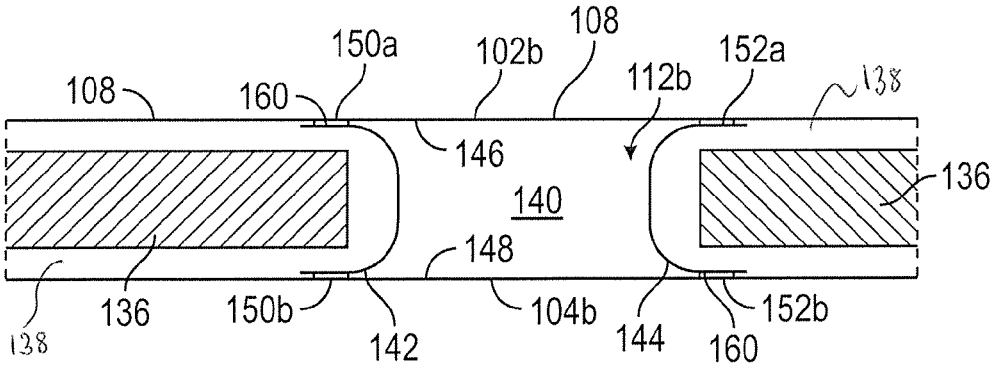
FIG. 4 is an enlarged cross-sectional view of the bottom/floor air passageway taken along line 4-4 of FIG. 3.

A cross-section of the bottom air delivery passageway 112*b* is illustrated in FIG. 4. However, construction of the passageways of the air passageway system 100 may be similar, except for the orientation thereof, throughout. The air passageway system 100 is constructed into the sidewall(s) 106 and the bottom 108 of the inflatable spa 110. In the depicted component, the bottom air delivery passageway 112*b* comprises a void/space 140 within the bottom 108 of the inflatable spa 110. The void/space 140 is defined by the interior and exterior surfaces 102*b*, 104*b* of the bottom 108 and first and second internal passageway walls 142, 144. To produce the void/space 140, the passageway walls 142, 144 are arranged throughout the one or more interior compartments 138, such as within the bottom/floor 108, of the inflatable spa 110. The passageway walls 142, 144 are sealed to respective inside faces 146, 148 of the interior and exterior surfaces 102*b*, 104*b* of the bottom 108 of the inflatable spa 110. Likewise, to fabricate the other portions of the air passageway system 100, such as the annular air deliver passageway 112*a* and the elevated annular air delivery passageway 132, the passageway walls 142, 144 are sealed to respective inside faces 146, 148 of the interior and exterior surfaces 102, 104 of the sidewall(s) 106. In an alternative embodiment, the above-detailed assembly of the passageway walls 142, 144 may construct flattened channels, rather than round tubular piping. According to still another alternative embodiment, the passageway system 100 may include flattened channels forming the bottom air delivery passageway 112*b* and the air injection ring passageway 116, while the remaining air passageways 112*a*, 114A-114L, 132, 134A-134L are substantial tubular/cylindrical. The flattened channels may be more easily integrated into the bottom/floor 108 and less uncomfortable for a user to step on when disposed within the floor 108.

Referring still to FIG. 4, the passageway walls 142, 144 are sealed to the inside faces 146, 148 at corresponding coupling points 150*a*, 150*b*, 152*a*, 152*b*. The passageway walls 142, 144, like the interior and exterior surfaces 102, 104 of the bottom 108 and the sidewall(s) 106 are fabricated from PVC, vinyl, coated canvas, and/or another water-tight and/or air-tight material suitable for construction of the inflatable spa 110. The passageway walls 142, 144 may be sealed to the inside faces 146, 148 according to PVC heat welding techniques in order to create an air-tight seal therebetween. Preferably, the passageway walls 142, 144 are welded, such as by high-frequency welding, sonic welding, or the like, directly to the inside faces 146, 148. In an alternative embodiment, PVC tapes 160 may also be used to seal the passageway walls 142, 144 to the inside faces 146, 148 or to one another. Accordingly, the air passageway system 100 may have air pumped therethrough under pressure and supply said air to the apertures 118 for injection into the water. The remaining one or more interior compartments 138 of the inflatable spa, as noted above and shown once again in FIG. 4, may have insulating material 136 disposed therein to facilitate structural and inflation advantages.

The apertures 118 through which the air is injected into the water contained within the inflatable spa 110 may be formed in the inside face 146 and traverse the interior surface 102. The apertures 118 may have valves disposed therein to allow airflow out of the apertures 118 while prevent water from entering the air passageway system 100. In example embodiments, valves are omitted and the apertures 118 are relatively simple holes. The perimeters of each hole may be reinforced. Still further, the air passageway system 100 constructed as described hereinabove may be collapsible, such as when the inflatable spa/pool 110 is stored and/or transported. Still further, the air passageways 158 of the air passageway system 100 may be collapsible and/or flexible when pressure is applied thereto, such as when a user walks or stands on the bottom/floor 108 of the inflatable spa/pool 110. Similarly, the air passageways 158 disposed within the sidewall(s) 106 may flex and/or collapse in response to pressure exerted thereon, such as by an impact and/or a user climbing in/out of the inflatable spa/pool 110.

In example embodiments, one or more portions of the air passageway system 100 may be rigid, such as the coupling points 124A-124L, 156A-156L. The air passageways 158 may be entirely flexible and integrally built into the inflatable spa/pool 110 as portions of the floor 108 and/or sidewall 106. This flexibility may allow the passageways 158 to be folded as part of the floor 108 and/or sidewall 106 during storage and/or transport of the inflatable spa/pool 110. However, if portions of the passageways 158 are rigid, flexible portions disposed therebetween may provide foldability. Even when particular rigid portions are present, the integration of the flexible PVC portions of the air passageways 158 allows for flexibility and folding similar to the foldability of the body of the inflatable spa/pool 110.

Figure 5:
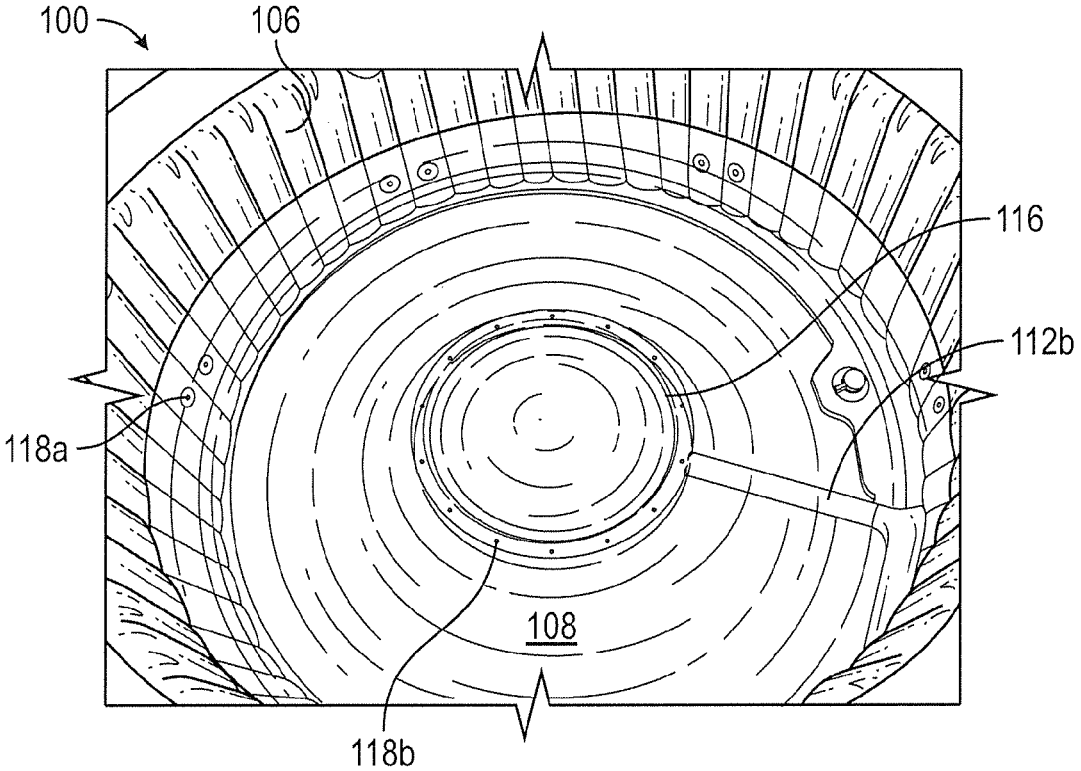
FIG. 5 is an enlarged isometric view from above of the spa of FIG. 1.
Figure 6:
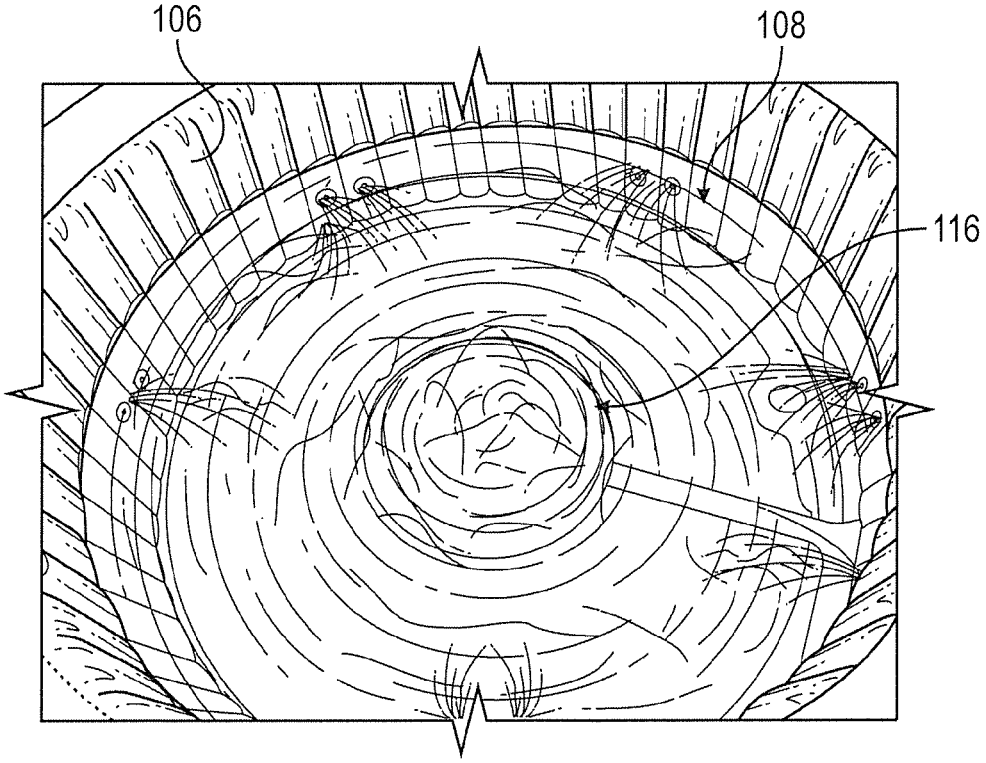
FIG. 6 is an enlarged isometric view from above of the spa of FIG. 1 with the air passageways active.
Figure 7:
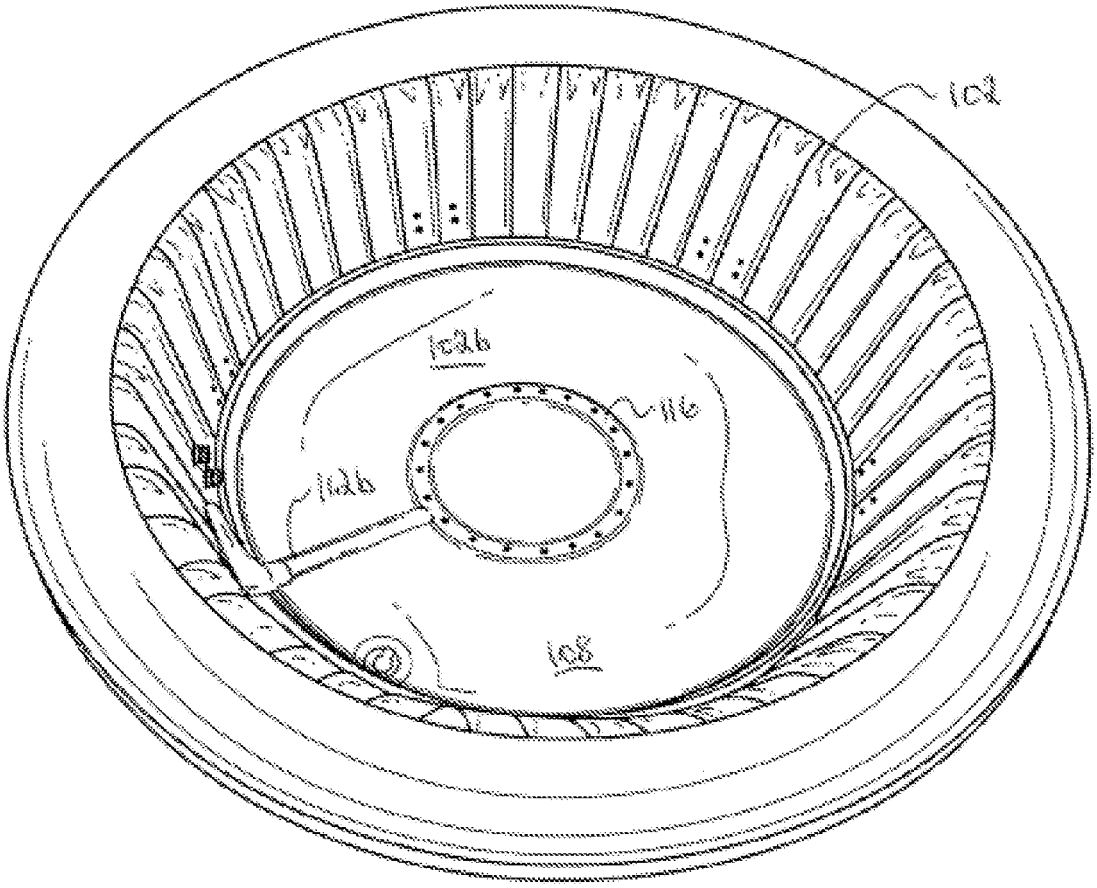
FIG. 7 is an enlarged isometric view from above of the spa in FIG. 1.
Figure 8:
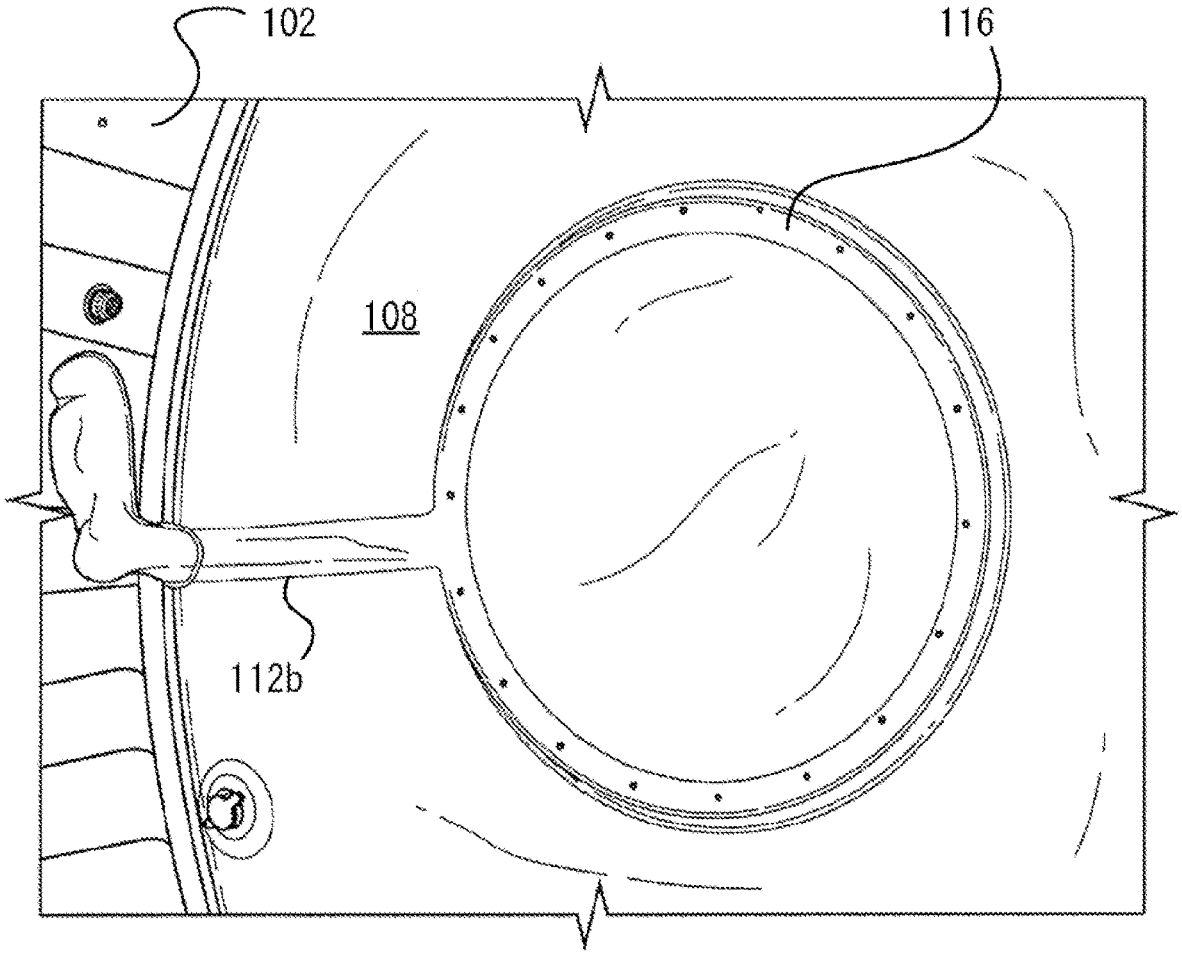
FIG. 8 is an enlarged plan view of the bottom air passageways of FIG. 1.
Figure 9:
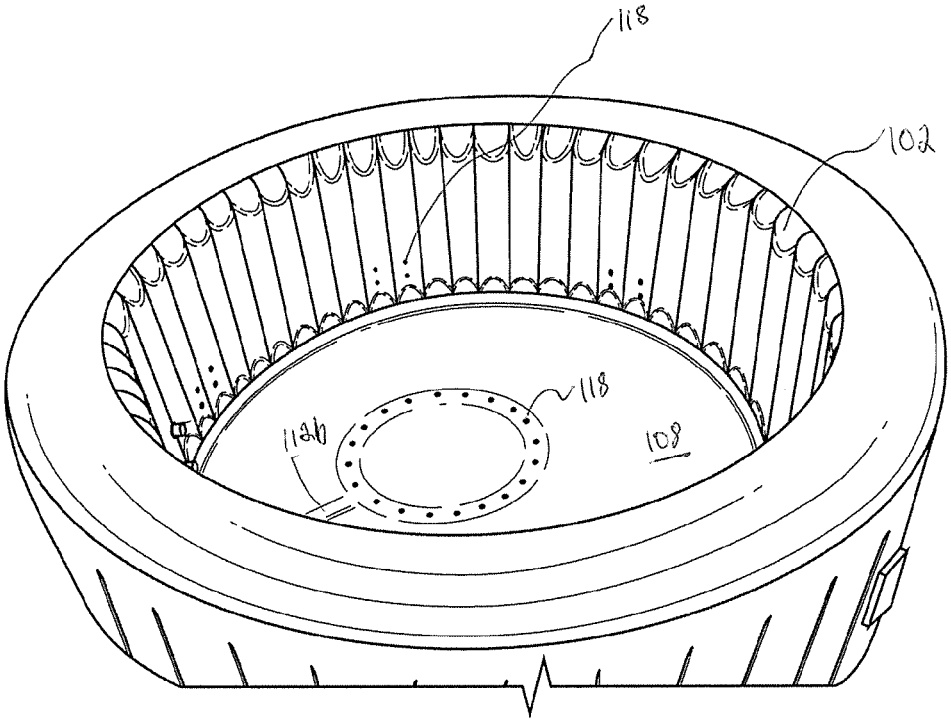
FIG. 9 is an isometric view of the spa of FIG. 1 further illustrating an example exterior.

FIG. 5 illustrates the inflatable spa filled with water while the air passageway system 100 is inactive. The bottom air delivery passageway 112*b* and the air injection ring passageway 116 are visible beneath the water. In this example embodiment, valves prevent water from entering the void(s)/space(s) 140 and filling the air passageway system 100 during the period of inactivity for the air passageway system 100. The air passageway system 100 is illustrated in operation in FIG. 6. The air injection ring passageway 116 arranged about a center of the bottom 108 of the inflatable spa 110 releases air into the water and may form one or more wave(s) thereby.

FIGS. 7, 8, 9, and 10 depict the inflatable spa 110 with the air passageway system 100 disposed therein without water provided within the spa 110. As detailed hereinabove, the air passageway system 100 is integral to the bottom 108 and sidewall(s) 106 of the inflatable spa 110 and some components thereof are visible even though the bottom 108 and sidewall(s) 106 are opaque. Specifically, the annular air delivery passageway 112*a*, bottom air delivery passageway 112*b*, and the air injection ring passageway 116 present as slight depressions in the interior surface 102 of the bottom 108 of the inflatable spa 110.

Alternative embodiments in which the apertures 118*a*, 118*b*, the air injection ring passageway 116, the pairs of upward air injection passageways 122*a*-122*f*; and the pairs of downward-oriented air injection passageways 154*a*-154*f* are arranged differently are contemplated hereby. The air injection ring passageway 116 may be rectangular, star-shaped, triangular, oval, ellipses, and/or custom-shaped. Further, more or fewer apertures and air injection passageways 124A-124L, 134A-134L may be present within the sidewall(s) 106. Additionally, in an example embodiment the downward-oriented and upward-oriented air injection passageways may be used simultaneously and/or mixed and matched interchangeably.

The embodiment(s) detailed hereinabove may be combined in full or in part, with any alternative embodiment(s) described.

INDUSTRIAL APPLICABILITY

The above disclosure may represent an improvement in the art because it allows for dispersing air throughout an inflatable pool/spa without the use of rigid piping. Further, this disclosure provides the user with improved storage and transport of the inflatable by omitting rigid piping. Still further, the disclosure improves the art by supplying an alternative configuration for providing air/jets through the floor of an inflatable pool/spa; in particular near a center or middle of the inflatable pool/spa, which would be otherwise technically difficult to reach with traditional rigid piping.

It is to be understood that all described elements and features in this disclosure can be formed of any number of materials including, but not limited to, polymers, rubbers, foams, ceramics, metals, metal alloys or any other material known to those skilled in the art. In particular, the material forming the air passageway system 100 and/or inflatable pool/spa 110 may be plastic, vinyl, coated fabric, and/or another suitable material or combination of materials. Valve(s) disposed on these components and/or the nozzles 126 (FIG. 10) may be formed from extruded plastic, machined aluminum, another metal alloy, and/or another materials or combination of materials suitable for manufacturing valve(s) for inflatables.

While some implementations have been illustrated and described, numerous modifications come to mind without significantly departing from the spirit of the disclosure; and the scope of protection is only limited by the scope of the accompanying claims.

Headings and subheadings, if any, are used for convenience only and do not limit the invention. The word exemplary is used to mean serving as an example or illustration. To the extent that the term include, have, or the like is used, such term is intended to be inclusive in a manner similar to the term comprise as comprise is interpreted when employed as a transitional word in a claim. Relational terms such as first and second and the like may be used to distinguish one entity or action from another without necessarily requiring or implying any actual such relationship or order between such entities or actions.

Phrases such as an aspect, the aspect, another aspect, some aspects, one or more aspects, an implementation, the implementation, another implementation, some implementations, one or more implementations, an embodiment, the embodiment, another embodiment, some embodiments, one or more embodiments, a configuration, the configuration, another configuration, some configurations, one or more configurations, the subject technology, the disclosure, the present disclosure, other variations thereof and alike are for convenience and do not imply that a disclosure relating to such phrase(s) is essential to the subject technology or that such disclosure applies to all configurations of the subject technology. A disclosure relating to such phrase(s) may apply to all configurations, or one or more configurations. A disclosure relating to such phrase(s) may provide one or more examples. A phrase such as an aspect or some aspects may refer to one or more aspects and vice versa, and this applies similarly to other foregoing phrases.

The disclosed systems and methods are well adapted to attain the ends and advantages mentioned as well as those that are inherent therein. The particular implementations disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative implementations disclosed above may be altered, combined, or modified and all such variations are considered within the scope of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

A phrase "at least one of" preceding a series of items, with the terms "and" or "or" to separate any of the items, modifies the list as a whole, rather than each member of the list. The phrase "at least one of" does not require selection of at least one item; rather, the phrase allows a meaning that includes at least one of any one of the items, and/or at least one of any combination of the items, and/or at least one of each of the items. By way of example, each of the phrases "at least one of A, B, and C" or "at least one of A, B, or C" refers to only A, only B, or only C; any combination of A, B, and C; and/or at least one of each of A, B, and C.

In one aspect, a term coupled or the like may refer to being directly coupled. In another aspect, a term coupled or the like may refer to being indirectly coupled. Terms such as top, bottom, front, rear, side, horizontal, vertical, and the like refer to an arbitrary frame of reference, rather than to the ordinary gravitational frame of reference. Thus, such a term may extend upwardly, downwardly, diagonally, or horizontally in a gravitational frame of reference.

The title, background, brief description of the drawings, abstract, and drawings are hereby incorporated into the disclosure and are provided as illustrative examples of the disclosure, not as restrictive descriptions. It is submitted with the understanding that they will not be used to limit the scope or meaning of the claims. In addition, in the detailed description, it can be seen that the description provides illustrative examples and the various features are grouped together in various implementations for the purpose of streamlining the disclosure. The method of disclosure is not to be interpreted as reflecting an intention that the claimed subject matter requires more features than are expressly recited in each claim. Rather, as the claims reflect, inventive subject matter lies in less than all features of a single disclosed configuration or operation. The claims are hereby incorporated into the detailed description, with each claim standing on its own as a separately claimed subject matter.

The claims are not intended to be limited to the aspects described herein, but are to be accorded the full scope consistent with the language claims and to encompass all legal equivalents. Notwithstanding, none of the claims are intended to embrace subject matter that fails to satisfy the requirements of the applicable patent law, nor should they be interpreted in such a way.

The use of the terms "a" and "an" and "the" and "said" and similar references in the context of describing the invention (especially in the context of the following claims) are to be construed to cover both the singular and the plural, unless otherwise indicated herein or clearly contradicted by context. An element proceeded by "a," "an," "the," or "said" does not, without further constraints, preclude the existence of additional same elements. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. Preferred embodiments of this disclosure are described herein, including the best mode known to the inventors for carrying out the disclosure. It should be understood that the illustrated embodiments are exemplary only, and should not be taken as limiting the scope of the disclosure.

What is claimed is:

1. An air passageway system, comprising:
an annular air delivery passageway;
a linear air delivery passageway;
an air injection ring passageway;
wherein the annular air delivery passageway, the linear air delivery passageway, and the air injection ring passageway are constructed from flexible polyvinyl chloride walls; and
wherein each of the linear air delivery passageway and the air injection ring passageway are defined on a lower side by an exterior surface of a spa, on lateral sides by internal passageway walls, and on an upper side by an interior surface of the spa, the interior surface of the spa being sealed to the internal passageway walls and having apertures formed therein through which air is injected.

2. The air passageway system of claim 1, wherein the air passageway system is disposed within the spa which is inflatable.

3. The air passageway system of claim 2, wherein the air passageway system disperses air throughout the inflatable spa, and wherein the air is injected into water contained within the inflatable spa.

4. The air passageway system of claim 1, wherein the annular air delivery passageway, the linear air delivery passageway, and the air injection ring passageway are constructed from a same material as the inflatable spa.

5. A system for aerating an inflatable spa, comprising:
a plurality of air delivery passageways comprising:
at least one air delivery passageway disposed within a sidewall of the inflatable spa, and
a linear air delivery passageway and an annular air delivery passageway, each of the linear air delivery passageway and the annular air delivery passageway being disposed within a floor of the inflatable spa, and defined:
on a lower side, by an exterior surface of the inflatable spa,
on lateral sides by internal passageway walls, and
on an upper side by an interior surface of the inflatable spa, the interior surface of the inflatable spa being sealed to the internal passageway walls;
one or more air injection passageways; and
one or more apertures for dispersing air from the one or more air injection passageways into water contained within the inflatable spa, the one or more apertures comprising apertures in the interior surface of the inflatable spa.

6. The aerating system of claim 5, wherein the plurality of air delivery passageways are operatively coupled to the one or more air injection passageways.

7. The aerating system of claim 6, wherein the plurality of air injection passageways further comprises an air injection ring passageway disposed within the floor of the inflatable spa.

8. The aerating system of claim 7, wherein the linear air delivery passageway is in communication with the air injection ring passageway to supply air thereto.

9. The aerating system of claim 7, wherein the air injection ring passageway comprises a plurality of apertures arranged in a circular pattern.

10. The aerating system of claim 5, wherein the plurality of air delivery passageways and the one or more air injection passageways are constructed of flexible polyvinyl chloride.

11. The aerating system of claim 5, wherein the plurality of air delivery passageways and the one or more air injection passageways each comprise a flattened channel.

12. An air passageway system, comprising:

an air passageway defined:

on a first side, by an exterior surface of a spa, on lateral sides, by a plurality of internal passageway walls, and on an upper side by an interior surface of the spa, the interior surface of the inflatable spa being sealed to the plurality of internal passageway walls and having apertures formed therein through which air is injected.

13. The air passageway system of claim 12, wherein the plurality of internal passageway walls are constructed from polyvinyl chloride.

14. The air passageway system of claim 13, further comprising polyvinyl chloride tape sealing the plurality of internal passageway walls to the interior surface of the spa.

15. The air passageway system of claim 13, wherein the exterior surface of the spa and the interior surface of the spa are sealed to the plurality of passageway walls by heat welding for polyvinyl chloride.

* * * * *